United States Patent [19]

Wardell, Jr.

[11] 4,160,510

[45] Jul. 10, 1979

[54] CRT WITH TENSION BAND ADAPTED FOR PUSHER-TYPE TENSIONING AND METHOD FOR PRODUCING SAME

[75] Inventor: Myron H. Wardell, Jr., Lititz, Pa.

[73] Assignee: RCA Corporation, New York, N.Y.

[21] Appl. No.: 873,613

[22] Filed: Jan. 30, 1978

[51] Int. Cl.[2] ..... H01J 29/87

[52] U.S. Cl. ..... 220/2.1 A; 24/23 R; 29/452; 100/2; 100/30; 358/246

[58] Field of Search ..... 220/2.1 A; 24/23 R, 24/23 B, 23 W, 22; 358/246; 100/30, 2; 29/452, 446

[56] References Cited

U.S. PATENT DOCUMENTS

| | | | |
|---|---|---|---|
| 1,396,190 | 11/1921 | Glisson | 24/23 R |
| 2,053,739 | 9/1936 | Prindle | 24/23 W |
| 2,188,710 | 1/1940 | Giovanini | 24/23 W X |
| 3,162,933 | 12/1964 | Trax et al. | 29/447 X |
| 3,220,593 | 11/1965 | Powell et al. | 220/2.1 A |
| 3,332,570 | 7/1967 | Powell et al. | 220/2.1 A |
| 3,456,076 | 7/1969 | Griswold et al. | 358/246 |
| 4,015,311 | 4/1977 | Custis | 24/23 W |

*Primary Examiner*—Allan N. Shoap

*Attorney, Agent, or Firm*—E. M. Whitacre; G. H. Bruestle; L. Greenspan

[57] ABSTRACT

A CRT (cathode-ray tube) in combination with a notch-sealed band tensioned around the tube characterized in that the inner overlapping end portion of the band is folded at least twice upon itself and is positioned between the tube and the band. In the method, one end of the band is folded at least twice upon itself. The band is positioned around the tube with the end portions overlapping, the folded portion toward the tube and a sheathlike metal clip around the overlapping end portions of the band and against the inside of the end fold of the folded end of the band. Then, the clip is pushed against the end fold, and the outer end portion of the band is pulled until the desired maximum tensile force is applied, at which point the clip and overlapping end portions of the band are notched together.

10 Claims, 10 Drawing Figures

CRT WITH TENSION BAND ADAPTED FOR PUSHER-TYPE TENSIONING AND METHOD FOR PRODUCING SAME

BACKGROUND OF THE INVENTION

This invention relates to the novel combination of a CRT (cathode-ray tube) and an implosion-protection system and to a novel method for producing this system on the CRT.

A cathode-ray tube comprising an evacuated glass bulb is a mass-produced article of commerce. The bulb usually includes a glass faceplate panel hermetically sealed to the wide end of a glass funnel. A luminescent screen is carried on the inner surface of the panel, and one or more electron guns are housed in a neck attached to the small end of the funnel. Some of the adverse effects of implosion of the bulb can be reduced or eliminated by providing an implosion-protection system around the panel.

Some of these systems include a tensioned metal band or strap completely around the bulb and overlapping itself. In one form, overlapping portions of the band pass through a sheathlike metal clip, and the overlapping band portions and the clip are notched together so as to maintain the tension in the band. The notched-together clip and overlapping band portions are referred to herein as a notched seal. Such systems are described, for example, in U.S. Pat. Nos. 3,220,593 to D. E. Powell et al, 3,382,999 to D. E. Powell et al and 3,845,530 to R. B. Platt.

To tension the band around the bulb in these systems, the metal band and clip are positioned around the bulb, and then the band is drawn up by a tensioning device which essentially holds the band in a clamp near the inner one end and pulls the band near the outer other end. The clip, which plays no part in the actual tensioning step, is notched together with the overlapping band portions therein. This method of tensioning, referred to herein as puller-type tensioning, had the disadvantage that part of the tensioning mechanism must be located between the band and the tube during tensioning. As a result, higher than the needed residual tension must be pulled so that, when the mechanism is removed after notching, the required residual tension of at least 400 kilograms, usually about 450 to 675 kilograms (1000 to 1500 pounds), remains in the band. There is also the further disadvantage that the magnitude of the residual tension is variable, being influenced by factors related to the relaxation of the band when the tensioning mechanism is removed.

Puller-type tensioning was borrowed from the packaging industry where it is widely used for strapping packages. The packaging industry also employs another method, referred to herein as pusher-type tensioning, which involves the clip in the tensioning step. In pusher-type tensioning, one end of the band is made into a "J" shape. The band and clip are positioned around the package with the open side of the "J" towards the package. Instead of clamping the inner one end of the band, the "J" of the band hooks over the clip. Then, with a unitary tensioning mechanism, entirely on the outer side of the band, the clip and the inner one end of the band are pushed while the outer other end of the band is pulled until the desired tension is realized. Then, with the tension applied, the clip and the overlapping band ends are notched together, as in puller-type tensioning.

Pusher-type tensioning has the advantage that no part of the tensioning mechanism is between the band and the package or CRT during tensioning. However, when pusher-type tensioning was applied to a CRT, and the required tension is applied to a band on a CRT by pusher-type tensioning, the "J" straightens out, and the band slips through the clip before it can be notched.

SUMMARY OF THE INVENTION

The novel combination comprises a CRT having a notch-sealed tension band around the CRT characterized in that the inner end of the band adjacent the CRT is folded at least twice upon itself into a convolution that is positioned between the tube and the notched seal. The novel structure can retain the required residual tension and permits the novel method to be practiced with the ultimate practical advantage of lower cost in making the implosion-protection system for the CRT.

The novel method comprises (a) folding one end portion of a metal band at least twice upon itself into a convolution, (b) positioning the band around the tube with the one end portion adjacent the tube and the other end portion overlapping the one end portion, (c) positioning a sheathlike clip around the overlapping end portions with one end of the clip against the inside of the end fold of the one end portion, (d) pushing the clip against the end fold and pulling the other end portion until the desired tension in the band is reached, and (e) notching together the clip and the overlapping end portions while the desired tension is applied.

The novel method follows the prior practice used in the packaging industry except that, instead of folding the one band end once upon itself, the band end is folded at least twice upon itself. As a result, when the required tension of at least 400 kilograms is applied to the band, the band end does not straighten and slip through the clip. By overcoming this problem, it is now possible to realize additional advantages of using a tensioning mechanism which is entirely on the outer side of the band during tensioning. Also, a lower tension need be pulled in order to realize the required residual tension in the band, and the magnitude of the residual tension is essentially the applied tension.

DETAILED DESCRIPTION OF THE PREFERRED EMBODIMENT

Figure 1:
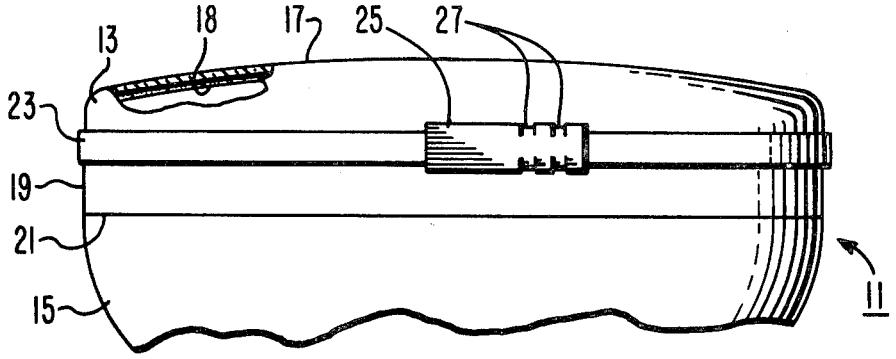
FIG. 1 is a fragmentary elevational view of an embodiment of the novel implosion-protected CRT of the invention.
Figure 2:
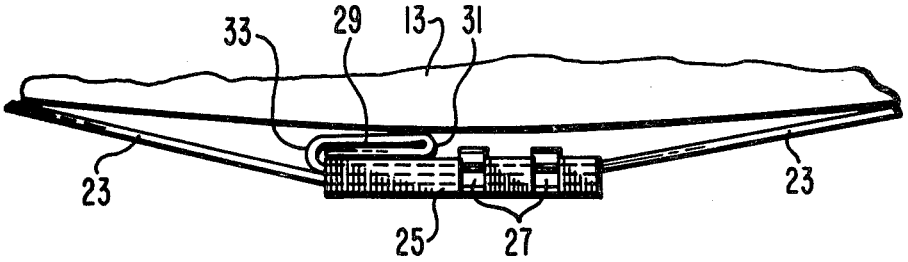
FIG. 2 is a fragmentary top view of the CRT shown in FIG. 1.

In a preferred embodiment, illustrated in FIGS. 1 and 2, a CRT 11 is shown, which includes an evacuated bulb or envelope which comprises a glass faceplate panel 13 at its front end, a glass neck (not shown) and an interconnecting glass funnel 15. The neck is closed at its distal end with a stem. An electron gun is housed in the neck and connects to stem leads which are supported by and extend through the stem. The neck is sealed to and closes the small end of the funnel 15. The panel 13 includes a glass viewing window 17 and an integral, rearwardly-extending glass sidewall 19. The panel 13 closes and is sealed to the large end of the funnel 15 along the seal line 21 at the terminal end of the sidewall 19. A luminescent screen 18 is supported on the inner surface of the viewing window 17.

The interior of the bulb 11 is evacuated to a high vacuum of the order of $10^{-5}$ mm of mercury. A metal band 23 encircles the sidewall 19 between the seal 21 and the window 17. The band 23 is tensioned to about 545 kilograms (1200 pounds) with the end portions thereof overlapped, the overlapped portions being in a sheathlike clip 25. Clip 25 and band 23 are fastened together with notches 27. The notches 27 are located off to one side of the clip 25. As shown in FIG. 2, the inner end portion 29 of the band 23 extends beyond the clip and is twice folded or coiled upon itself into a "J" shape, with the "J" portion hooked over the edge of the clip 25. The twice-folded end portion of the band, which is the short leg of the "J," is positioned between the clip 25 and the panel 13 a distance less than half the length of the clip 25, although the twice-folded end portion could be about half the length or more of the clip 25. The extreme end of the band lies in the second fold of the band. The metal band 23 is a commercially-available carbon-steel strapping, epoxy-and-zinc coated, about 18.75 1 mm (0.75-inch) wide and about 0.675 mm (0.027-inch) thick. The clip 25, also of carbon steel, is matched to be used with the strapping. Any commercially-available metal strapping and matching clip able to carry the required tension may be used.

Figure 3:
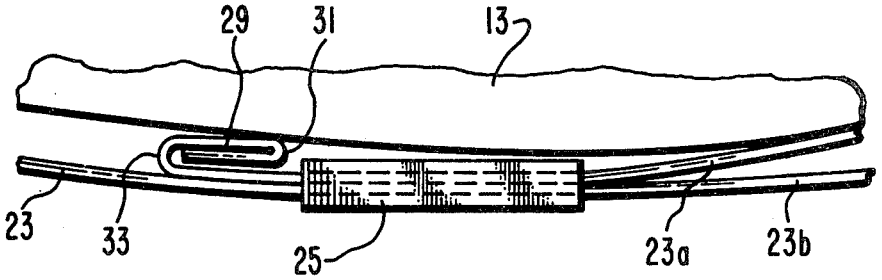
FIGS. 3 and 4 are fragmentary top views of the CRT shown in FIGS. 1 and 2 in the process of being fabricated by the novel method including pusher-type tensioning.
Figure 4:
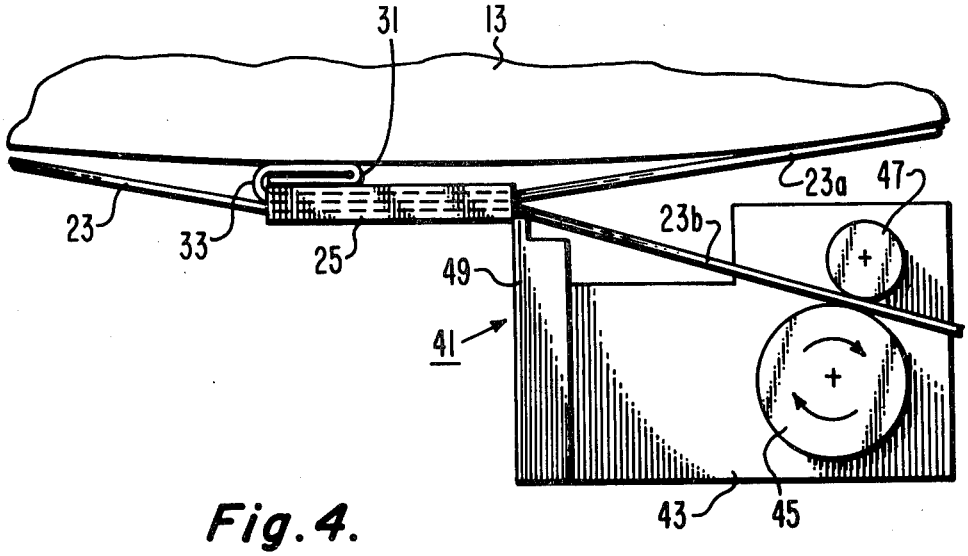

FIGS. 3 and 4 illustrate in part the novel method used to prepare the CRT shown in FIGS. 1 and 2. First, one end portion of a band 23 is double folded upon itself into a convolution and formed into a "J" shape (FIG. 3) with a first fold 31 spaced from a second fold 33. The band 23 is threaded through a sheathlike clip 25 and then threaded through again to make a loop. The CRT 11 is supported in a table, and the loop is then positioned loosely around the sidewall 19 of the CRT 11 with the open side of the "J" facing inward toward the sidewall 19 as shown in FIG. 3. The band 23 overlaps itself inside and along side the clip 25, with the inner end portion thereof closer to the sidewall. The inner end portion of the band is designated **23*a* and the outer end portion is designated 23*b*. The clip 25 is then slid into the "J" so that the edge of the clip 25 is against the inside of the end fold or second fold 33, as shown in FIG. 4. A tensioning mechanism 41 then engages the clip 25 and band 23. The mechanism 41 comprises a base 43 which is supported from the table supporting the CRT 11. The outer end portion 23*b* of the band is placed between an air-driven friction wheel 45 and an idler wheel 47 which are mounted on the base 43. Bolted to the base 43 is a seal restraint plate 49, which engages the end of the clip 25 opposite from the end engaging the "J" formed at the end portion of the inner band 23*a*. With the band 23, clip 25, CRT 11 and the tensioning mechanism 41 positioned as shown in FIG. 4, the friction wheel is actuated to rotate, clockwise as shown in FIG. 4, to pull the outer band 23*b* away from the clip 25 and simultaneously to push the clip 25 away from the friction wheel 45. The opposite end portion of the band 23 is restrained from moving by the "J" shape, which is hooked over the opposite end of the clip 25, so that the friction wheel 45 draws up the slack amount of band 23 around the panel 13 and then imparts the required maximum applied tension of abut 550 kilograms in the band 23. The presence of the two spaced folds 31 and 33 and the band material therebetween prevents the "J" from straightening out and thereby prevents the band 23 from slipping through the clip 25 before it is notched. With the required tension applied, the double-folded end portion of the band 23 extends part way across the clip 25 and holds the clip 25 slightly away from the panel 13. With the required tension applied, the clip and overlapping band portions are notched together in that region of the clip 25 that is not adjacent the double-folded band portion, thereby forming the notched seal. After the notched seal is made, the friction wheel 45 is inactivated, and the tensioning mechanism 41 is removed. The outer portion 23*b* of the band is worked back and forth until it breaks off at the edge of the clip 25. Alternatively, the outer band portion 23*b*** may be cut off.

Figure 5:
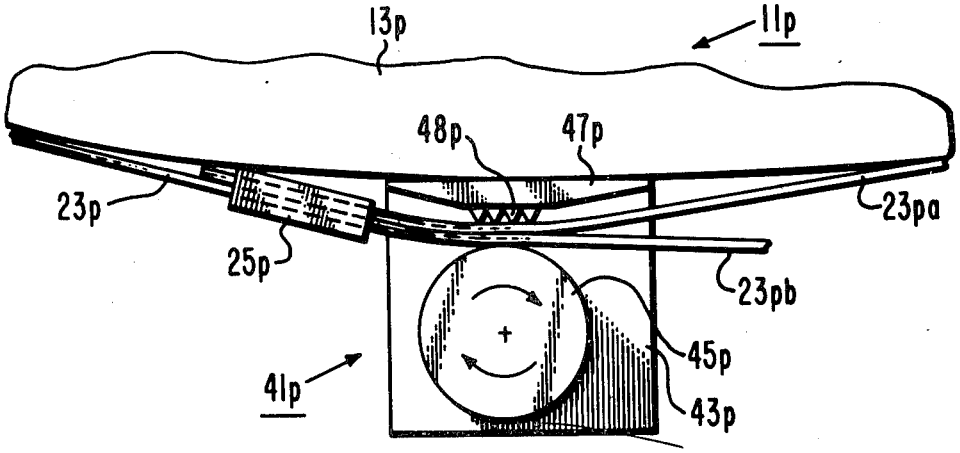
Fig. 5. PRIOR ART
FIGS. 5 and 6 are fragmentary top views of a CRT in the process of being fabricated by the prior method including puller-type tensioning.
Figure 6:
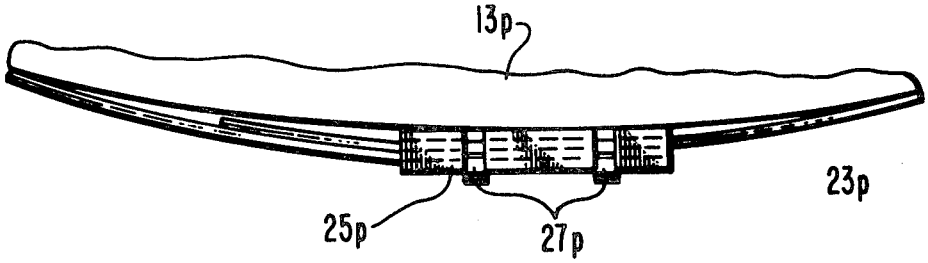
Fig. 6. PRIOR ART

The novel method with pusher-type tensioning may be compared with the prior method with puller-type tensioning, as illustrated in FIG. 5. In the prior method, a straight length of steel band **23*p* is twice threaded through a clip 25*p* to form a loop which is loosely placed around the panel 13*p* of a CRT. A puller-type tensioning mechanism 41*p* now engages overlapped end portions of the band 23 adjacent, but not including, the clip 25*p*. The mechanism 41*p* includes a base 43*p* which is supported from the table supporting the CRT 11*p*, a friction wheel 45*p* and an idler plate 47*p* having teeth 48*p* opposite the wheel 45*p*. The mechanism is located so that overlapping portions of the band 23*p* are between the wheel 45*p* and the plate 47*p*, and the plate 47*p* is between the band 23*p* and the panel 13*p*. The friction wheel 45*p* presses the overlapping band 23*p* against the teeth 48*p* of the plate 47*p*, which hold the inner portion 23*pa* of the band in place. The friction wheel 45*p* also rotates to slide the outer band 23*b* over the inner band portion 23*pa* until the slack is taken from the loop and greater than the required residual tension is applied. With this applied tension, the clip and overlapping band portions are notched together to form the notched seal. Then, the friction wheel 45*p* is inactivated and the tensioning mechanism is removed, producing the structure shown in FIG. 6. When the plate 47*p* is removed, some small slack is introduced so that the tension is reduced down to the required residual tension. Hence, higher tensions must be applied with puller tensioning than with pusher tensioning in order to provide the required final residual tension in the band. Also, it should be noted that puller tensioning requires a plate 47*p* to be slid under the band 23*p*** and then, after tensioning, slid out again. This sometimes results in scratching or bruising of the glass, which defects are completely avoided by the novel method.

Figure 7:
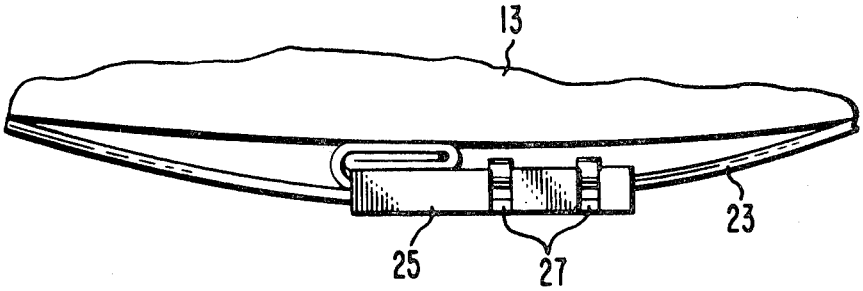
FIG. 7 is a fragmentary top view of another embodiment of the novel CRT.
Figure 8:
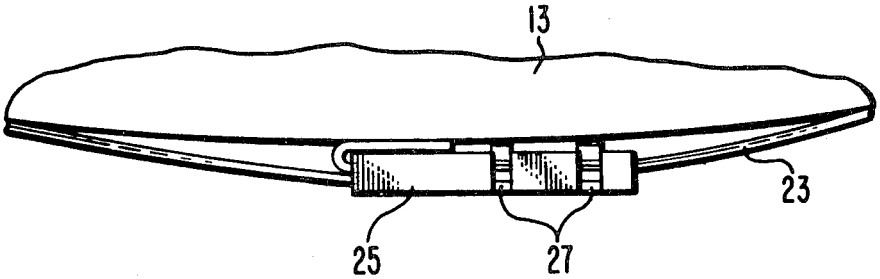
FIGS. 8, 9 and 10 are fragmentary top views of CRTs which were fabricated with pusher-type tensioning but which are not included in the invention herein.
Figure 9:
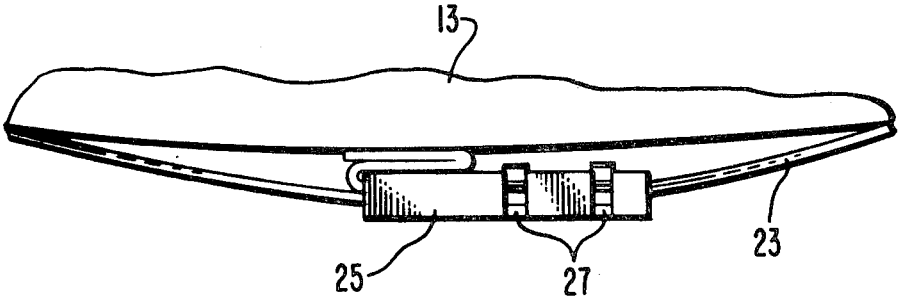
Figure 10:
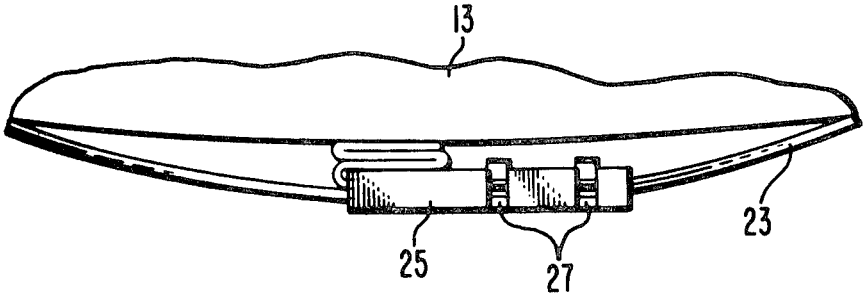

An important feature of the novel method is that the band end be folded at least twice upon itself into a convolution and formed to a "J" shape. It may be folded thrice upon itself, as shown in FIG. 7. But one fold, as shown in FIG. 8, is not adequate to hold a sufficient tension in the band 23. A double fold or a triple fold, which are not folded upon themselves; that is, do not form a convolution, as shown in FIGS. 9 and 10 respectively, are also not adequate for the same reason, since they will straighten when the tension required for an implosion-protection system is applied.

The novel combination and novel method have been described with respect to an implosion-protection system consistng essentially of a single tensioned band. However, the invention includes also systems with multiple tensioned bands which may be adjacent and/or on top of one another. Also, the single or multiple tensioned bands may be used with rim plates as shown, for example, in the above-cited patents or with other metal structures, and/or with plastic coatings as shown, for example, in the above-cited patents. Also, the novel CRT and method may include or omit the use of a plastic tape under part or all of the tension band adjacent a glass surface.

The clip plays an important role in the novel method since it transmits the entire tensioning force by a compressive force in the clip. As a result, the clip, which is available commercially for this purpose, is designed to resist deformation when the tensioning force is applied. While the embodiment described above employs preformed clips, the clip may be formed partly or entirely around the overlapped end portions of the band prior to tensioning. The legs of the clip after notching may or may not overlap one another.

I claim:

1. A cathode-ray tube in combination with a notch-sealed tension band around the tube characterized in that the inner end portion of said band adjacent said tube is folded at least twice upon itself and is positioned between the tube and the notched seal, said inner end portion comprising an extreme end, a series of connected sections of band material with a fold between adjacent sections, the one section furthest from said end being within said seal, another section connected to said one section being adjacent said tube and the remaining sections being between said another section and said seal.

2. The combination defined in claim 1 wherein said tension band is tensed to at least about 400 kilograms.

3. The combination defined in claim 1 wherein said tension band is about 18.75 mm wide and about 0.675 mm thick.

4. The combination defined in claim 1 wherein said notched seal comprises a sheathlike clip around overlapping end portions of said band, and the folded inner end of said band extends between said clip and said tube a distance less than the length of said clip, and said clip and said end portions therein are notched together in the remaining length of said clip.

5. The combination defined in claim 1 including a cathode-ray tube comprising an evacuated envelope including a glass faceplate panel having integral glass sidewalls, said band being a steel band tensioned around the sidewalls of said panel, said band having an outer end portion overlapping said inner end portion, and a metal clip around a part of the overlapping end portions, said clip and end portions being notched together to form said seal, said inner end portion extending beyond said clip and is double folded upon itself into a convolution and positioned between said clip and said sidewall a distance less than the length of said clip.

6. In a method for tensioning a metal band around a cathode-ray tube, the steps of (a) folding one end portion of said band at least twice upon itself, the first fold of said one end portion being spaced from the extreme end of said band by a first section of band material and a second fold being spaced from said first fold by a second section of band material and a third section of band material being connected to said second section at said second fold, said first section being between said second section and said third section, (b) positioning said band around said tube with said one end portion adjacent said tube and the other end portion overlapping said one end portion, (c) positioning a clip around the overlapping band portions with one end of said clip against the inside of said second fold of said one end portion, said third section being within said clip, said second section being adjacent said tube and said first section being between said second section and the outside of said clip, (d) pushing said clip against said second fold and pulling said other end portion until the required tension in said band is reached, (e) and notching together said clip and said overlapping band portions while said required tension is applied.

7. The method defined in claim 6 including folding said one end portion only twice upon itself.

8. The method defined in claim 6 wherein said required tension is at least about 400 kilograms.

9. The method defined in claim 6 wherein said tension is in the range of 450 to 675 kilograms.

10. The method defined in claim 6 wherein said pushing and said pulling are applied simultaneously without inserting any tool part between the tube and the band.

* * * * *